US007942401B2

(12) United States Patent
Jeong

(10) Patent No.: US 7,942,401 B2
(45) Date of Patent: May 17, 2011

(54) ATM EQUIPPED WITH STRUCTURE FOR PREVENTING ROTATION OF STACK ROLLER

(75) Inventor: Yun Seok Jeong, Gyunggi-Do (KR)

(73) Assignee: Nautilus Hyosung Inc., Seoul (KR)

( * ) Notice: Subject to any disclaimer, the term of this patent is extended or adjusted under 35 U.S.C. 154(b) by 465 days.

(21) Appl. No.: 11/771,447

(22) Filed: Jun. 29, 2007

(65) Prior Publication Data

US 2008/0001352 A1 Jan. 3, 2008

(30) Foreign Application Priority Data

Jun. 30, 2006 (KR) ..... 10-2006-0061378

(51) Int. Cl.
*B65H 85/00* (2006.01)

(52) U.S. Cl. ..... 271/3.08; 271/314

(58) Field of Classification Search ..... 271/3.01, 271/3.08, 117, 118, 314, 220
See application file for complete search history.

(56) References Cited

U.S. PATENT DOCUMENTS 4,275,874 A * 6/1981 DiBlasio ..... 271/4.1
4,753,431 A * 6/1988 Fujimoto et al. ..... 271/3.08
5,553,840 A * 9/1996 Arikawa ..... 271/3.08
6,467,766 B2 * 10/2002 Minamishin et al. ..... 271/21
7,243,914 B2 * 7/2007 Tokunaga et al. ..... 271/3.01
7,380,784 B2 * 6/2008 Mizuno ..... 271/207
7,556,262 B2 * 7/2009 Mizuno ..... 271/207
2004/0041330 A1 * 3/2004 Ko et al. ..... 271/121
2005/0200073 A1 * 9/2005 Mizuno ..... 271/207
2008/0006564 A1 * 1/2008 Jeong ..... 209/534
2009/0014946 A1 * 1/2009 Nagura et al. ..... 271/220

* cited by examiner

*Primary Examiner* — Stefanos Karmis
*Assistant Examiner* — Michael C McCullough
(74) *Attorney, Agent, or Firm* — Fish & Richardson P.C.

(57) ABSTRACT

The invention provides an ATM that can stably stack paper money by preventing the rotation of stack rollers when paper money is deposited. The ATM includes feed rollers, stack rollers, and elastic members. The feed rollers convey paper money separated one-by-one by pickup rollers onto a money withdrawal path, or convey paper money conveyed along a money deposit path into a recyclebox. Peripheries of the feed rollers are formed of rubber. Each of the stack rollers includes wings. When paper money is deposited, the stack rollers come in contact with the feed rollers. Peripheries of the stack rollers are formed of synthetic resin. The elastic members push the stack rollers against the feed rollers, and apply elastic forces to the stack rollers such that a frictional force between paper money and the stack rollers is smaller than that between paper money and the feed rollers.

2 Claims, 10 Drawing Sheets

ATM EQUIPPED WITH STRUCTURE FOR PREVENTING ROTATION OF STACK ROLLER

BACKGROUND OF THE INVENTION

1. Field of the Invention

The present invention relates to an ATM (automatic teller machine) that prevents the rotation of stack rollers when paper money is deposited. In particular, the present invention relates to an automatic teller machine that can stably stack paper money in a recyclebox by preventing the rotation of stack rollers, which is caused by the friction generated between outer peripheral surfaces of the stack rollers and paper money, when paper money is deposited.

2. Description of the Related Art

In general, a cash dispenser unit (CDU) and a billing recycling machine (BRM) have been used as automatic teller machines that quickly and conveniently provide various financial services at anytime without consulting with a person. The CDU has been used since the financial services have been computerized, and is used to withdraw only cash. The BRM has a deposit function in addition to a cash dispensing function.

The automatic teller machine is provided with a recyclebox that is a circulatory box for storing paper money to be withdrawn and deposited.

FIG. 1 is a schematic side view showing the structure of a general recyclebox.

The recyclebox 1 includes pickup rollers 11, feed rollers 12, guide rollers 13, a stack guide 20, and stack rollers 10. The pickup rollers 11 separate paper money 3, which is stacked on a push plate 50, one-by-one, and convey the paper money 3 onto a money deposit/withdrawal path 40 and a money withdrawal path 42. The outer peripheries of the feed rollers 12 are partially positioned on the money deposit/withdrawal path 40. Accordingly, the feed rollers 12 convey the paper money 3, which is separated one-by-one by the pickup rollers 11, onto the money withdrawal path 42, or convey paper money 3, which is conveyed along a money deposit path 41, onto the push plate 50. The guide rollers 13 are provided at the end of the money deposit/withdrawal path 40 so as to overlap the feed rollers 12 by a predetermined depth. The stack guide 20 allows paper money 3, which is to be deposited during a money deposit operation, not to come in contact with the pickup rollers 11. Further, the stack guide is swung downward to guide paper money 3, which is to be deposited, along a conveyance path of paper money 3. Wings 10*a* of the stack rollers 10 are positioned on the conveyance path of paper money 3, and push the end of the paper money 3 to be conveyed along the stack guide 20 so that the paper money 3 is aligned and stacked. Reference numerals 30, 31, and 32, which are not described above, indicate a conveying roller, a paper money depositing pinch roller, and a paper money withdrawing pinch roller, respectively.

Specifically, the push plate 50 descends during a paper money deposit operation in order to secure a money deposit space in the recyclebox 1. Then, paper money to be deposited is conveyed to the money deposit space by the feed rollers 12, and is stacked on the push plate 50. Further, the stack guide 20 and the stack rollers 10 facilitate the stacking of the paper money, and the push plate 50 ascends during a paper money withdrawal operation such that the paper money stacked on the push plate comes in contact with and presses the pickup rollers 11. Accordingly, the stacked paper money is separated and withdrawn one-by-one.

Meanwhile, the stack guide 20 is swung upward during the money withdrawal operation such that the push plate 50 comes in contact with and presses the pickup rollers 11. For this reason, the pickup rollers 11 come in contact with the paper money stacked on the push plate 50. As a result, the stacked paper money is separated and withdrawn one-by-one.

In this case, the stack rollers 10 are provided to come in contact with the feed rollers 12. When paper money is deposited, the stack rollers are rotated due to the contact friction generated between the stack rollers and the lower surface of the paper money. Accordingly, the wings 10*a* push the end of the paper money.

However, when paper money is deposited, outer peripheral surfaces of the stack rollers 10 come in contact with the lower surface of the paper money. For this reason, the stack rollers additionally apply a conveying force to the paper money. As a result, the speed of the paper money to be deposited increases, which causes the paper money to be unstably stacked.

That is, if the stack rollers 10 are rotated by a frictional force against paper money, a conveying force of the feed rollers 12 is added to a conveying force of the stack rollers 10 when the end of the paper money is released from the stack rollers 10. Accordingly, the paper money passes by the stack guide 20 at high speed, and is strongly bumped against an inner wall 2 of the recyclebox 1. For this reason, the paper money is unstably stacked on the push plate 50, which causes troubles in withdrawing the paper money.

SUMMARY OF THE INVENTION

The invention has been made to solve the above-mentioned problem, and an object of the invention is to provide an automatic teller machine that can stably stack paper money. The automatic teller machine prevents the rotation of stack rollers while paper to be deposited comes in contact with the stack rollers, and rotates the stack rollers directly after an end of the paper money is released from the stack rollers, in order to reduce the speed of the paper money to be stacked in a recyclebox.

According to an aspect of the invention, an automatic teller machine includes feed rollers, stack rollers, and elastic members. The feed rollers convey paper money, which is separated one-by-one by pickup rollers, onto a money withdrawal path, or convey paper money, which is conveyed along a money deposit path, into a recyclebox. An outer peripheral surface of each feed roller that comes in contact with paper money is formed of rubber. Each of the stack rollers includes a plurality of wings on the outer peripheries thereof. When paper money is deposited, outer peripheral surfaces of the stack rollers come in contact with the feed rollers. An outer peripheral surface of each stack roller that comes in contact with paper money is formed of synthetic resin. The elastic members are provided to push the stack rollers against the outer peripheral surfaces of the feed rollers. The elastic members apply elastic forces to the stack rollers such that a frictional force between paper money to be deposited and the stack rollers is smaller than a frictional force between paper money to be deposited and the feed rollers.

In the above-described automatic teller machine, a central shaft of each stack roller may be fitted to one end of a stack roller fixing member. A stack roller supporting member may be swingably connected to the other end of the stack roller fixing member by a pin. A stack roller pivot around which the elastic members are wound may be fitted to the stack roller supporting member.

A rotation limiting portion having a square shape may be formed at one corner of the stack roller fixing member. A rotation portion having a round shape may be formed at the other corner of the stack roller fixing member.

DESCRIPTION OF THE PREFERRED EMBODIMENT

The structure and operation of a preferred embodiment of the invention will be described in detail below with reference to the accompanying drawings.

Figure 1:
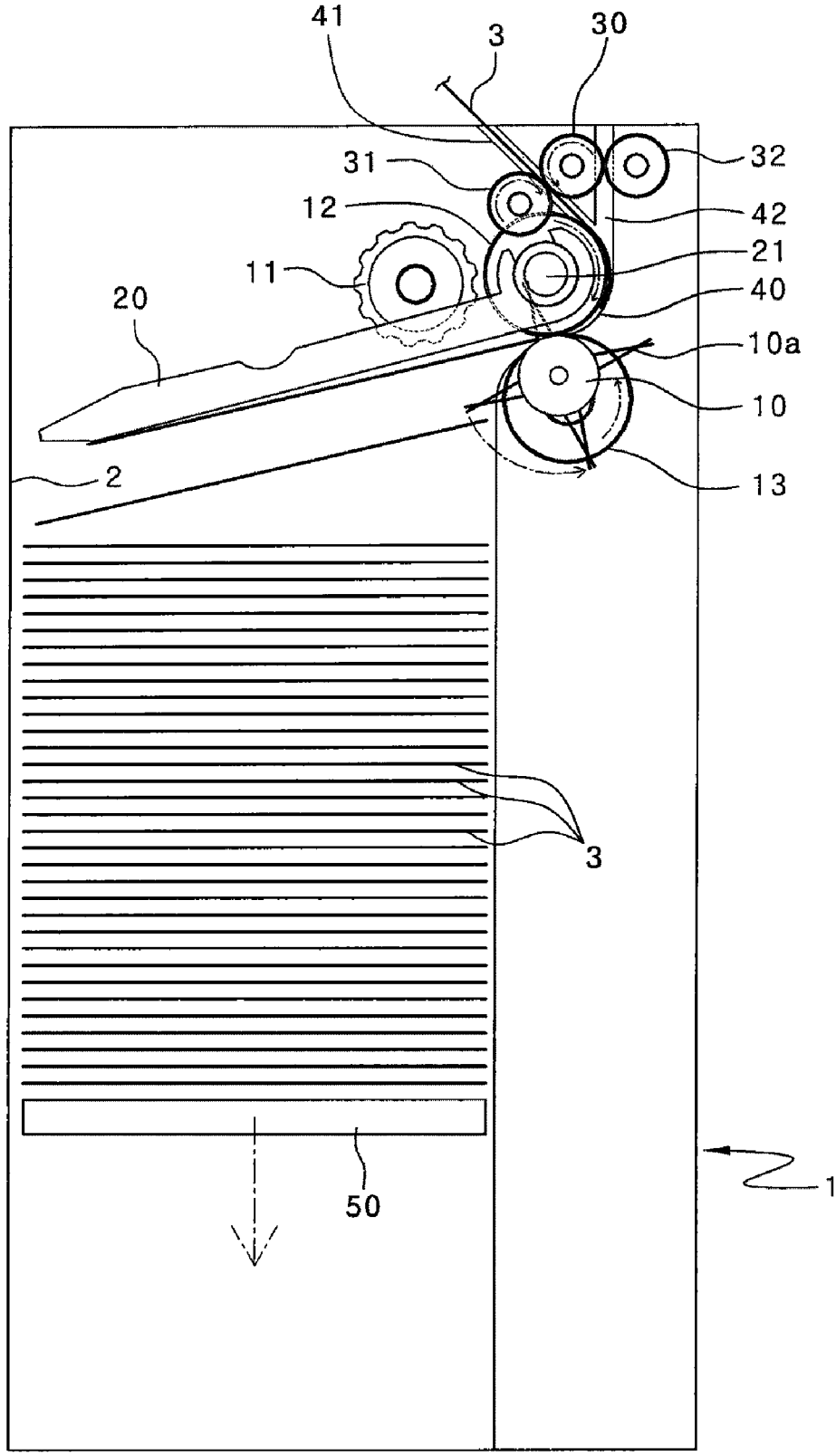
FIG 1 PRIOR ART
FIG. 1 is a schematic side view showing the structure of a general recyclebox.
Figure 2:
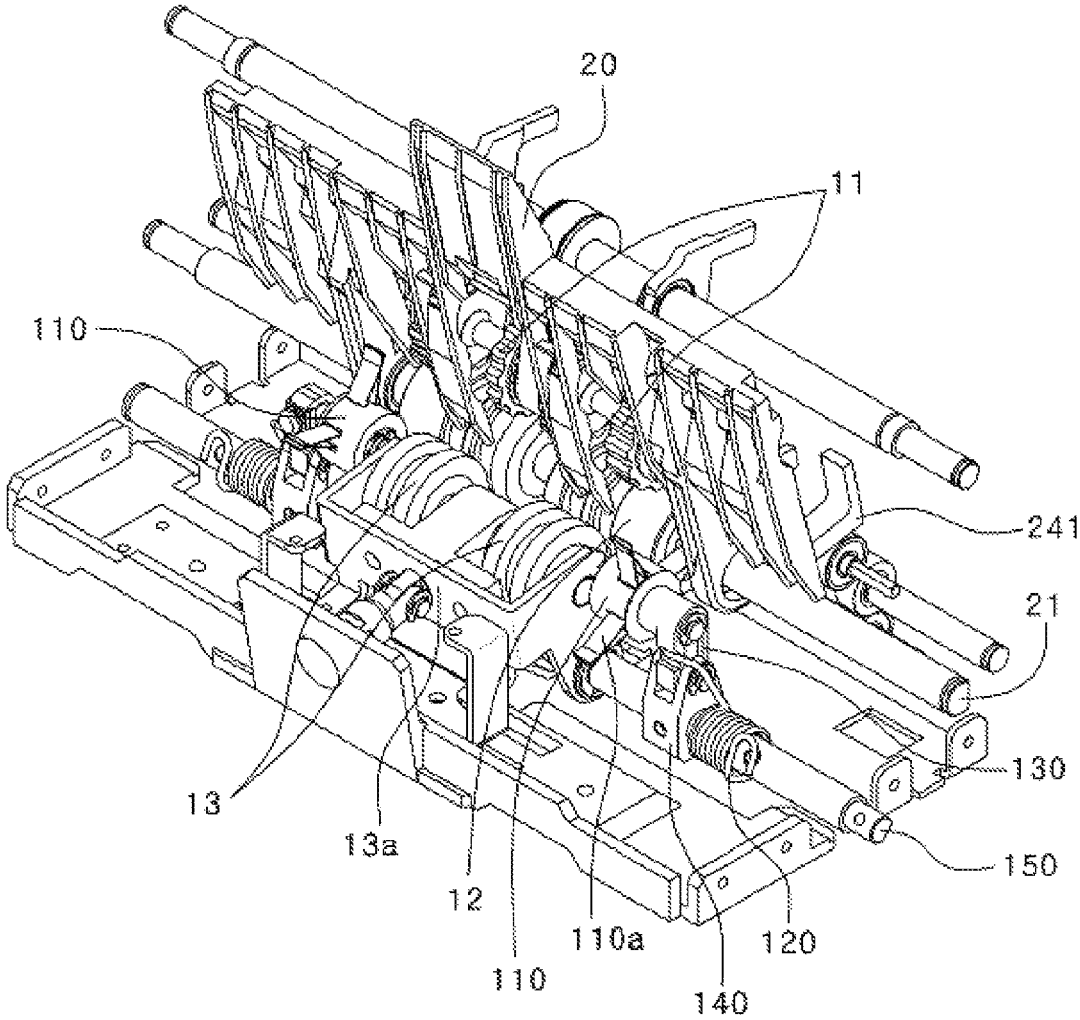
FIG. 2 is a perspective view showing the structure for preventing the rotation of stack rollers according to an embodiment of the invention.
Figure 3A:
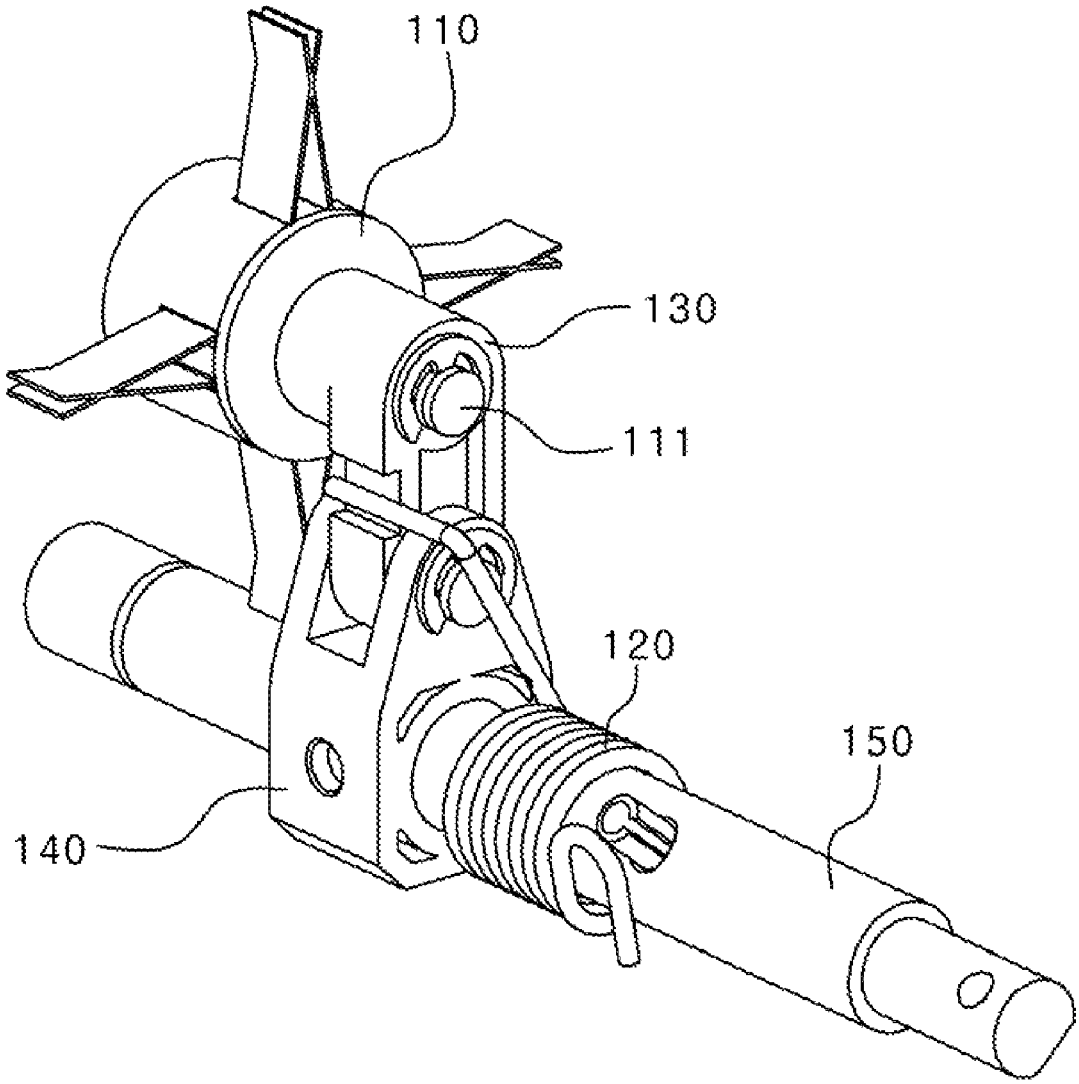
FIGS. 3A and 3B are assembled and exploded perspective views showing the structure for preventing the rotation of the stack rollers according to the embodiment of the invention.
Figure 3B:
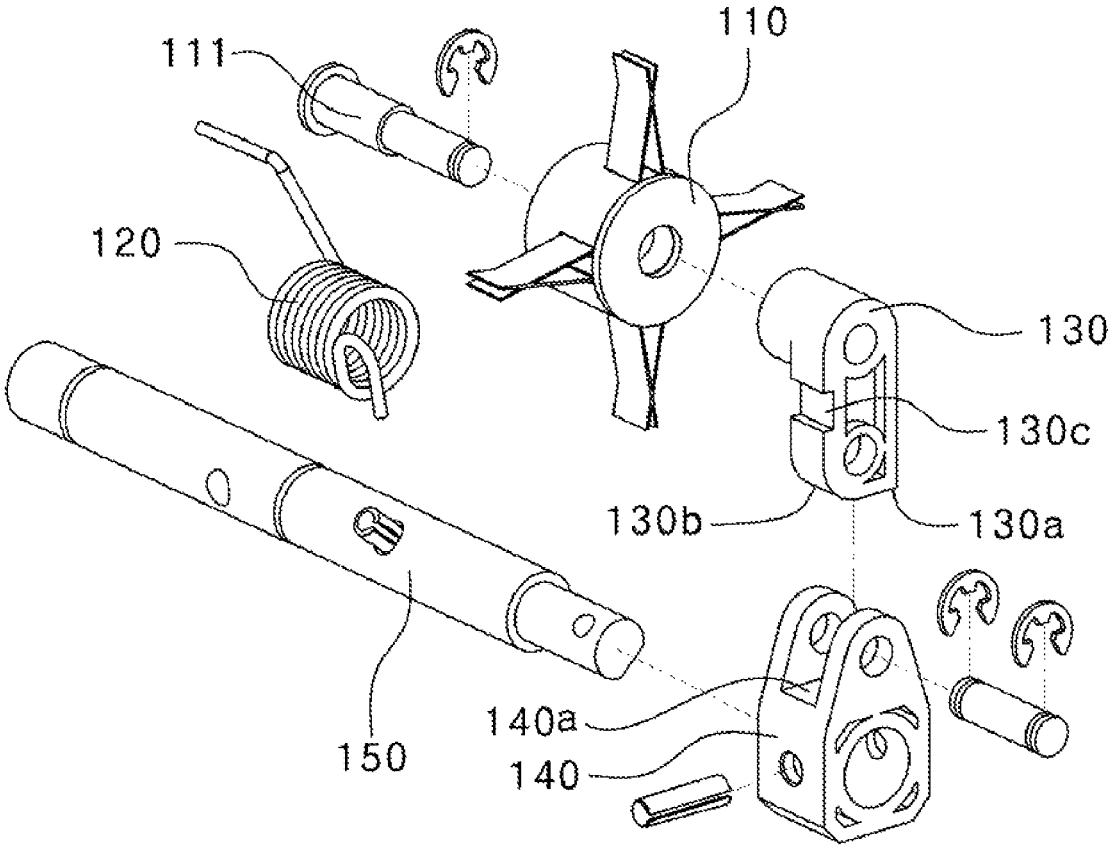

FIG. 2 is a perspective view showing the structure for preventing the rotation of stack rollers according to an embodiment of the invention, and FIGS. 3A and 3B are assembled and exploded perspective views showing the structure for preventing the rotation of the stack rollers according to the embodiment of the invention.

Referring to FIGS. 2 and 3, an automatic teller machine (ATM) according to an embodiment of the invention includes pickup rollers 11, feed rollers 12, guide rollers 13, and a stack guide 20. The pickup rollers 11 separate paper money stacked on a push plate 50 one-by-one. The feed rollers 12 convey paper money, which is separated one-by-one by the pickup rollers 11, onto a money withdrawal path, or convey paper money, which is conveyed along a money deposit path, onto the push plate 50. The guide rollers 13 are provided to overlap the feed rollers 12 by a predetermined depth. The stack guide 20 guides the upper surface of the paper money to be deposited.

The ATM according to the embodiment of the invention further includes stack rollers 110. When paper money is deposited, the stack rollers come in contact with the feed rollers 12. Each of the stack rollers 110 includes wings 110*a*, which push the end of the paper money to be deposited, on the peripheries thereof. When paper money is deposited, the feed rollers 12 are rotated by a motor (not shown). In this case, since the stack rollers 110 come in contact with the feed rollers 12, the stack rollers 110 are rotated together with the feed rollers 12.

The ATM according to the embodiment of the invention further includes elastic members 120. The elastic members 120 apply elastic forces to the stack rollers 110 such that the stack rollers 110 are pushed against the feed rollers 12.

In this case, each of the feed rollers 12 is formed of rubber that has large friction against paper money. Further, each of the stack rollers 110 is formed of synthetic resin and has a smooth surface to reduce the friction against the paper money. Further, each of the elastic members 120 is formed of a coil spring.

Due to the above-mentioned structure, when paper money is deposited, a frictional force caused by the peripheral surface of each feed roller 12 formed of rubber is applied to the upper surface of the paper money. Therefore, a conveying force is applied to the paper money such that the paper money is fed into a recyclebox 1. In contrast, since the lower surface of the paper money comes in contact with each stack roller 110 formed of synthetic resin, a very small frictional force is generated between the paper money and the stack rollers 110.

Accordingly, since a small frictional force is generated between the paper money and the stack rollers 110, the stack rollers 110 are not rotated while the paper money to be deposited comes in contact with the peripheral surface of each stack roller 110.

However, when the end of the paper money is released from the stack roller 110, the outer peripheral surface of the stack roller 110 comes in contact with the outer peripheral surface of the feed roller 12. Accordingly, the stack rollers 110 are rotated. When the stack rollers 110 are rotated, the wings 110*a* push the end of the paper money released from the stack roller 110, such that the paper money is stacked on the push plate 50.

Accordingly, while paper money comes in contact with the stack rollers 110, only a conveying force caused by the rotation of the feed rollers 12 is applied to the paper money. Further, since the stack roller 110 is not rotated, an additional conveying force is not applied to the paper money. For this reason, the speed of the paper money when the paper money is released from the stack roller 110 is much smaller than that of the paper money when a conveying force caused by the rotation of the stack rollers 110 is applied to the paper money. Therefore, paper money is stably stacked in the recyclebox.

In this case, a spring constant of each of the elastic members 120 may be experimentally determined. That is, if an elastic force applied to the stack roller 110 by the elastic member 120 is too large, a frictional force between the stack rollers 110 and the lower surface of paper money increases. For this reason, the stack roller 110 may be rotated. Therefore, the spring constant should be determined within an appropriate range. For example, the spring constant of each of the elastic members 120 may be determined such that the frictional force generated between the lower surface of the paper money and the outer peripheral surfaces of the stack rollers 110 is smaller than the frictional force generated between the upper surface of the paper money and the outer peripheral surfaces of the feed rollers 12.

An example of the structure where the stack roller 110 is connected to the elastic member 120 will be described below.

A central shaft 111 of the stack roller 110 is fitted to one end of a stack roller fixing member 130, and a stack roller supporting member 140 is connected to the other end of the stack roller fixing member 130. Further, a stack roller pivot 150 is fitted to the stack roller supporting member 140.

A spring used as the elastic member 120 is wound several times around the stack roller pivot 150, and one end of the spring is caught by a spring groove 130*c* of the stack roller fixing member 130. Accordingly, the spring pushes the stack roller 110 against the feed roller 12.

A rotation limiting portion 130*a* having a square shape is formed at one lower corner of the stack roller fixing member 130. The stack roller 110 is configured as follows: as the stack roller pivot 150 is rotated, the stack roller 110 is swung downward in order to prevent the stack roller 110 from interfering with the paper money to be withdrawn when paper money is withdrawn. In this case, the elastic member 120 applies an elastic force toward the upper side, and the rotation limiting portion 130*a* comes in contact with an inner surface 140*a* of the of the stack roller supporting member 140. Accordingly, an upward swing angle of the stack roller 110 is limited.

Meanwhile, a rotation portion 130*b* having a round shape is formed at the other lower corner of the stack roller fixing member 130 opposite to the rotation limiting portion 130*a*. That is, since the stack roller 110 is pushed upward by the elastic member 120, it is not necessary to limit a downward swing angle of the stack roller. Further, when paper money passes by, the stack roller should be swung by an angle corresponding to the thickness of the paper money. For this reason, the rotation portion 130*b* is formed.

Figure 4:
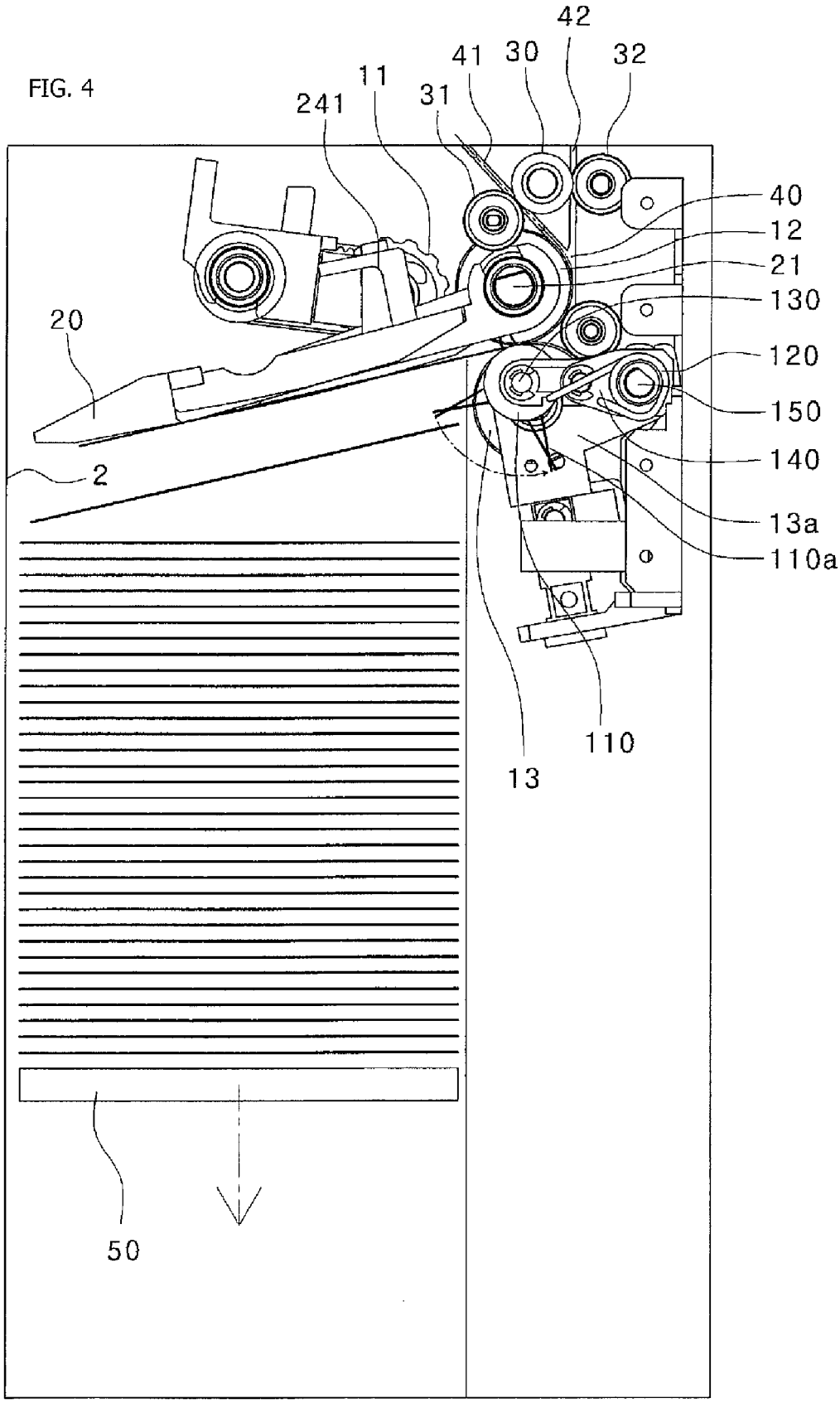
FIG. 4 is a side view showing that the stack roller of the structure for preventing the rotation of the stack rollers according to the embodiment of the invention is swung upward when paper money is deposited.
Figure 5:
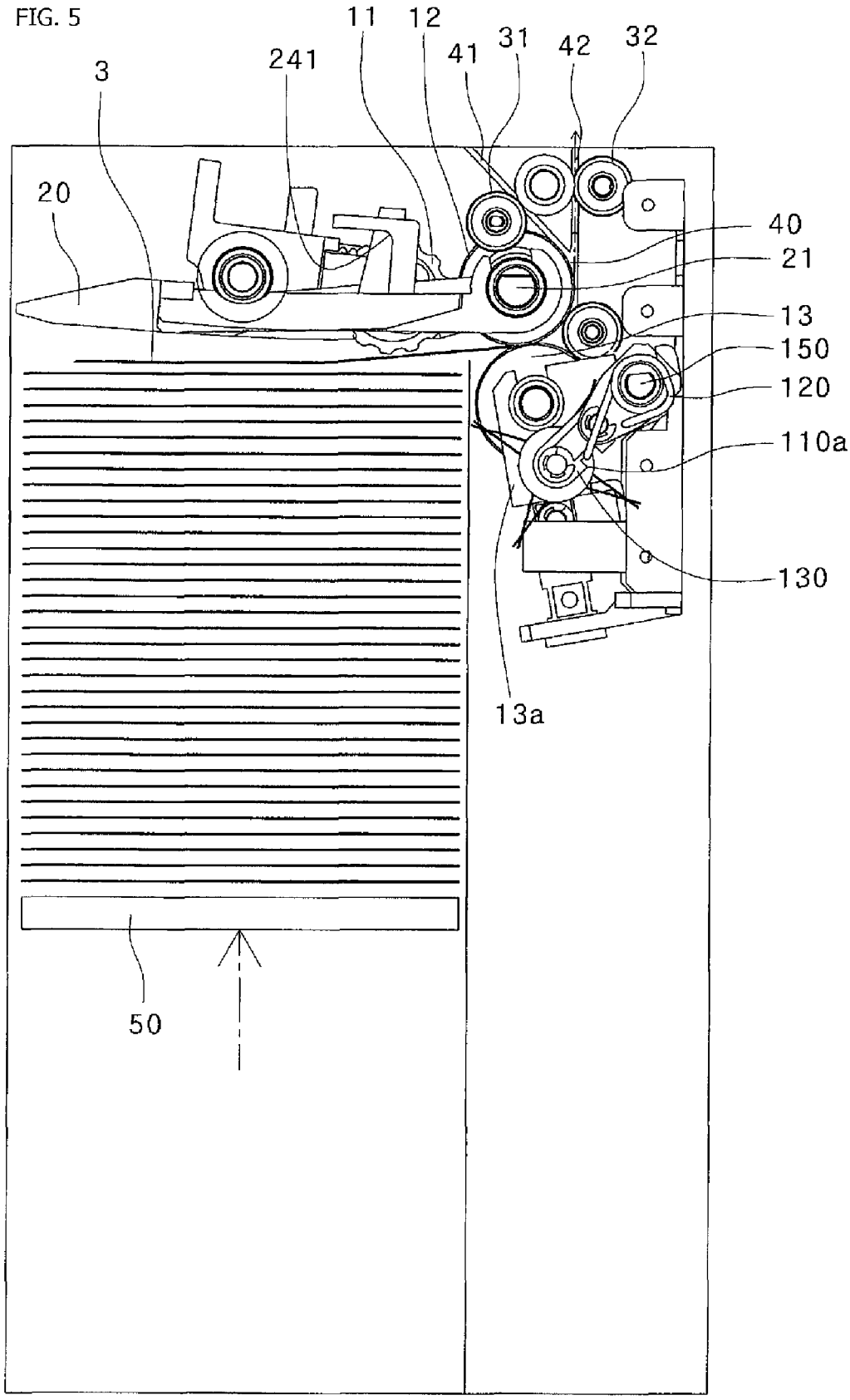
FIG. 5 is a side view showing that the stack roller of the structure for preventing the rotation of the stack rollers according to the embodiment of the invention is swung downward when paper money is withdrawn.

FIG. 4 is a side view showing that the stack roller of the structure for preventing the rotation of the stack rollers according to the embodiment of the invention is swung upward when paper money is deposited, and FIG. 5 is a side view showing that the stack roller of the structure for preventing the rotation of the stack rollers according to the embodiment of the invention is swung downward when paper money is withdrawn.

Referring to FIG. 4, when paper money is deposited, the stack roller 110 is swung upward about the stack roller pivot 150 in order to push the end of the paper money. The outer peripheral surface of the stack roller 110 comes in contact with the outer peripheral surface of the feed roller 12. In this case, the stack guide 20 is swung downward in order to guide paper money to be deposited. When the paper money to be deposited is released from the outer peripheral surface of the stack roller 110, the end of the paper money is pushed by the rotating wings 110*a*. Accordingly, the paper money is bumped against an inner wall 2 of the recyclebox, and then stacked on the push plate 50.

Referring to FIG. 5, when paper money 3 is withdrawn, the stack roller 110 is swung downward about the stack roller rotary shaft 150. Accordingly, the stack roller does not prevent the paper money 3 from being withdrawn. Further, since the stack guide 20 is swung upward, the pickup roller 11 comes in contact with the upper surface of the paper money 3. Accordingly, the paper money is separated one-by-one.

Figure 6:
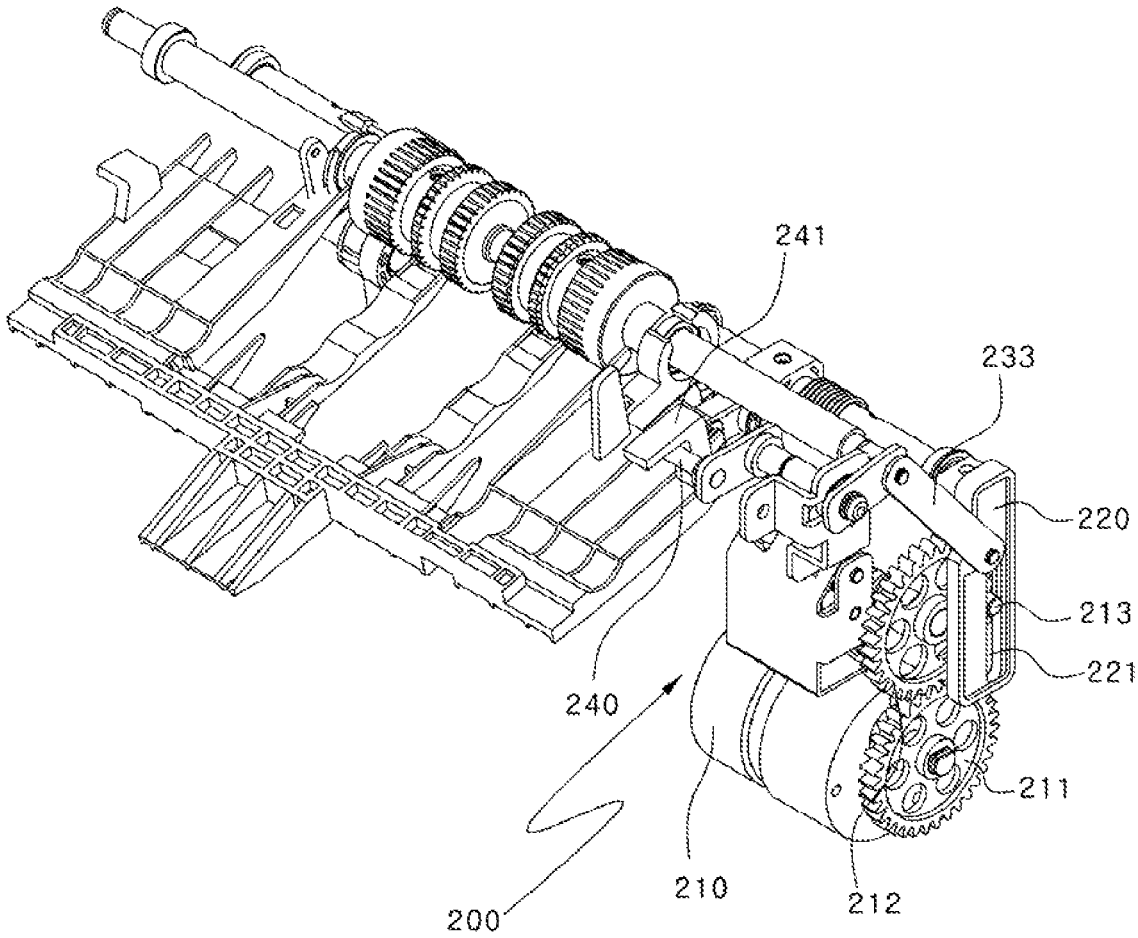
FIGS. 6 and 7 are perspective views of a driving unit that rotates a stack roller pivot of the embodiment of the invention.
Figure 7:
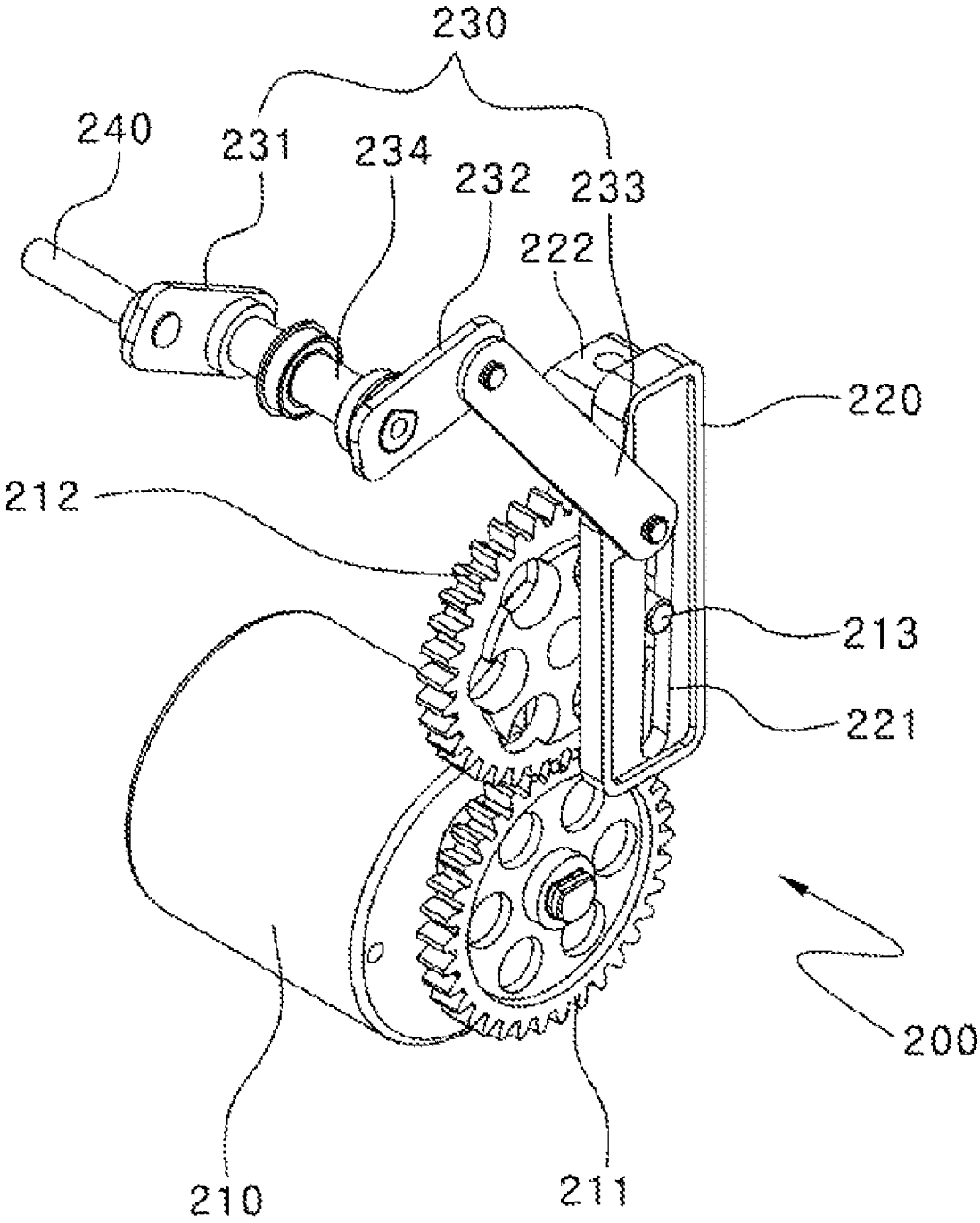
Figure 8A:
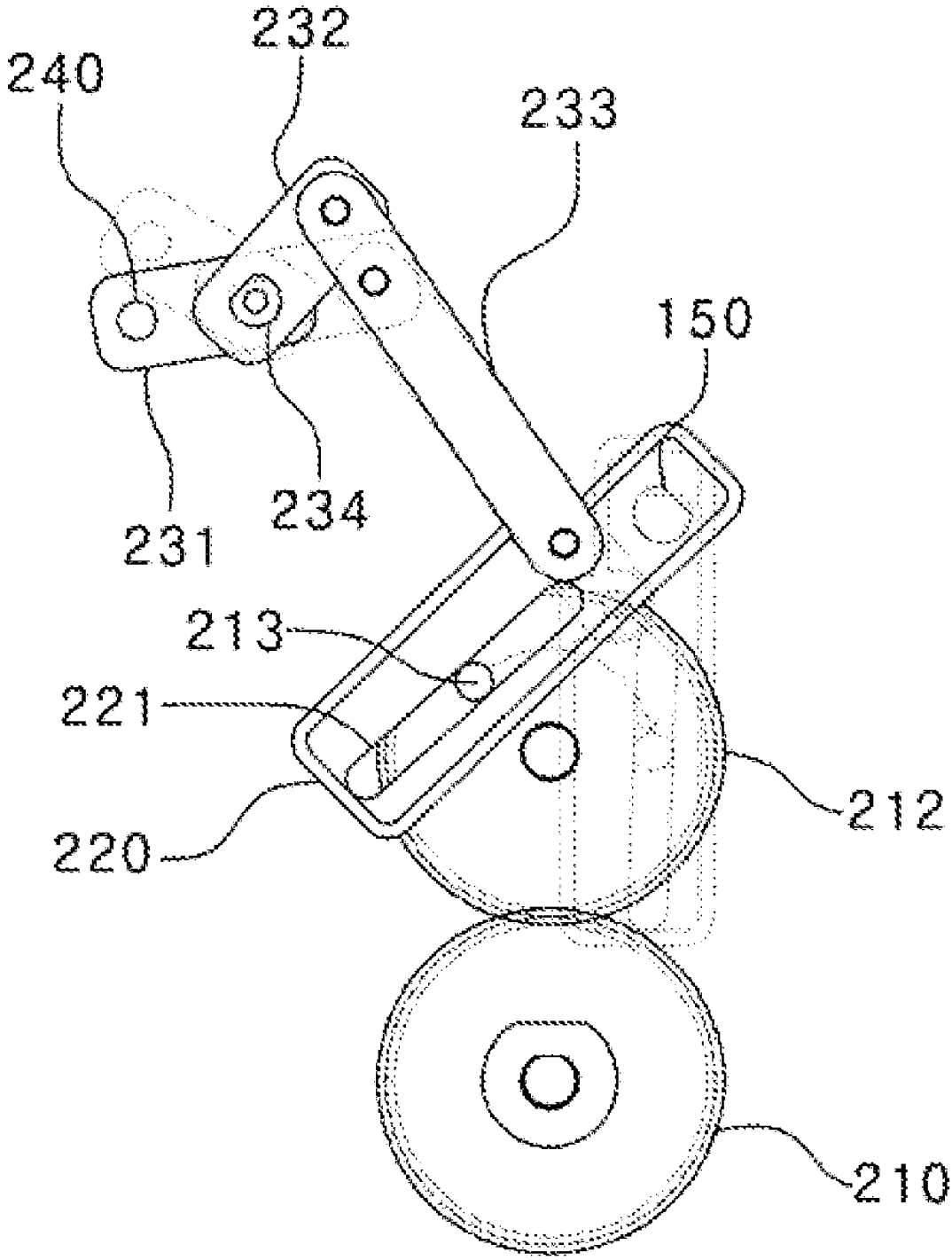
FIG. 8A is a view showing that a stack roller is swung upward and a stack guide is swung downward when paper money is deposited.
Figure 8B:
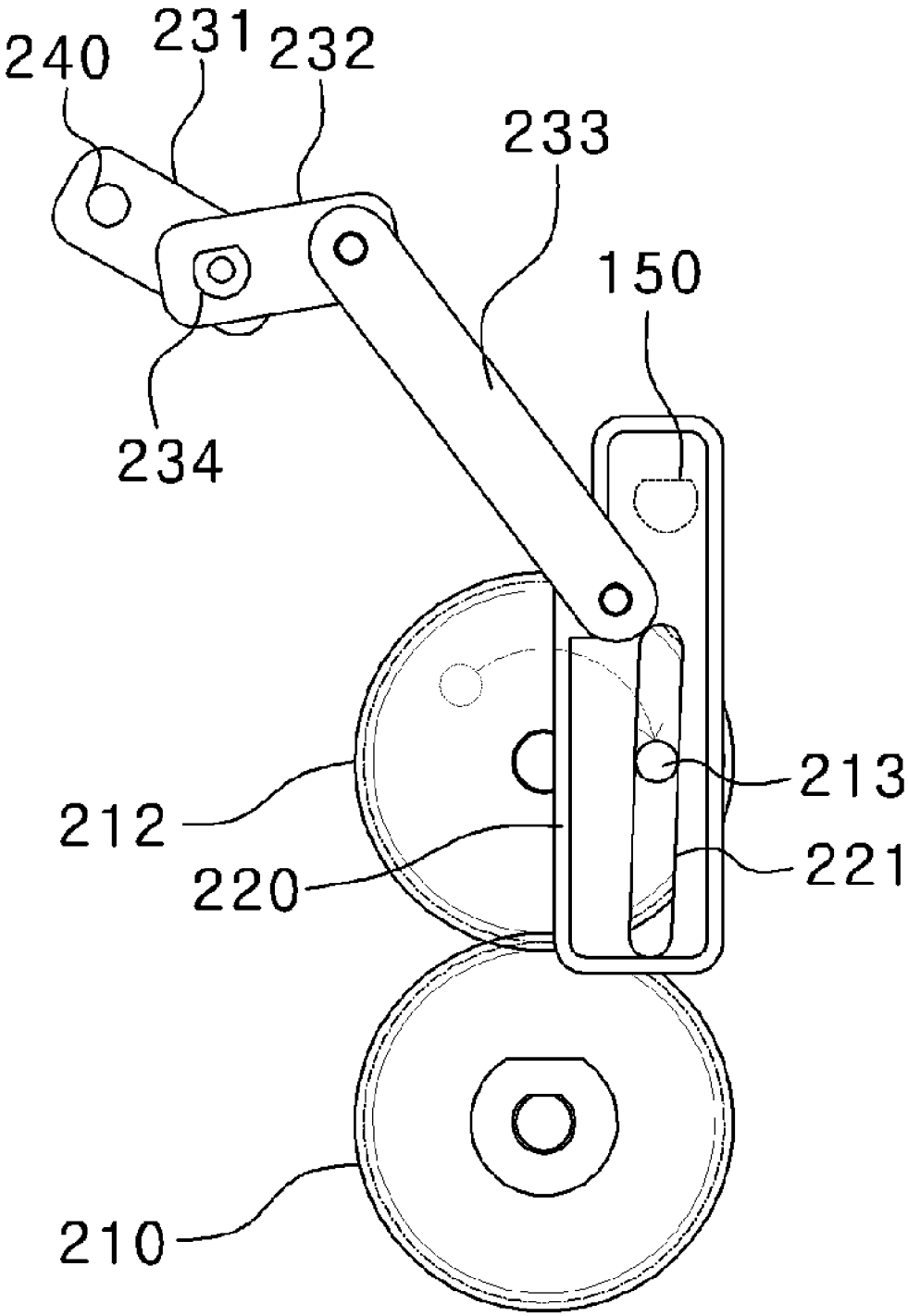
FIG. 8B is a view showing that a stack roller is swung downward and a stack guide is swung upward when paper money is withdrawn.

FIGS. 6 and 7 are perspective views of a driving unit that rotates a stack roller pivot of the embodiment of the invention. FIG. 8A is a view showing that an upward-swing stack guide of the stack roller is swung downward when paper money is deposited, and FIG. 8B is a view showing that a downward-swing stack guide of the stack roller is swung downward when paper money is withdrawn.

A driving unit 200 for driving the stack roller pivot 150 will be described with reference to FIGS. 6 and 7.

A portion of the stack roller pivot 150, which has a D-shaped cross section, is fitted to a coupling protrusion 222 of a slide bar 220. Although not shown, a groove corresponding to the portion of the stack roller pivot 150, which has a D-shaped cross section, is formed in the coupling protrusion 222. A slide slot 221 is formed in the slide bar 220 in a longitudinal direction of the slide bar. Further, a gear 212, which is rotated by a rotational driving force transmitted from a driving motor 210 via a driving gear 211, is provided. A guide protrusion 213 protrudes from the gear 212. The guide protrusion 213 is inserted into the slide slot 221, and the slide bar 220 is slidably swung depending on the rotation of the gear 212.

Meanwhile, when paper money is deposited, the stack roller 110 is swung upward. When paper money is withdrawn, the stack roller 110 is swung downward. When paper money is deposited, the stack guide 20 is swung downward. When paper money is withdrawn, the stack guide 20 is swung upward. The stack roller 110 and the stack guide 20 are swung upward or downward at the same time by one driving motor 210.

To obtain the above-mentioned structure, for example, a link connection unit 230 that includes a first link bar 231, a second link bar 232, a third link bar 233, and a first link bar pivot 234 is connected to the slide bar 220.

A rod 240 is connected to the first link bar 231, and the rod 240 is caught by a stack guide hook 241 that is bent to have an L shape.

When the gear 212 is rotated in a clockwise direction from a position of FIG. 8A to a position of FIG. 8B, the stack roller pivot 150 fitted to the coupling protrusion 222 of the slide bar 220 is rotated in a counterclockwise direction. For this reason, the stack roller 110 that is eccentrically fixed to the stack roller pivot 150 is also swung downward to recede from the conveyance path of paper money. Further, the first link bar 231, the second link bar 232, the third link bar 233, and the first link bar pivot 234, which are linked to the slide bar 220, also operate relative to each other, such that the rod 240 is swung. As a result, the stack guide 20 also recedes from the conveyance path of paper money.

In contrast, when the gear 212 is rotated in a counterclockwise direction from a position of FIG. 8B to a position of FIG. 8A, the stack roller 110 and the stack guide 20 are positioned on the conveyance path of paper money in a reverse order of the above-mentioned order.

As described in detail above, according to the automatic teller machine of the invention, when paper money is deposited, the stack roller is not rotated while paper money comes in contact with the stack roller. Further, when the paper money is released from the stack roller, the stack roller is rotated due to contact friction between the feed roller and the stack roller. For this reason, it is possible to prevent an excessive force from being applied to the paper money. Accordingly, when paper money is deposited, the paper money is stably stacked and stably withdrawn. As a result, it is possible to reduce the machine troubles.

What is claimed is:

1. An automatic teller machine comprising:

feed rollers conveying paper money, configured such that an outer peripheral surface of each feed roller that comes in contact with paper money being formed of rubber;

stack rollers, each including a plurality of wings on the outer peripheries thereof, outer peripheral surfaces of the stack rollers coming in contact with the feed rollers when paper money is deposited, and an outer peripheral surface of each stack roller that comes in contact with paper money being formed of synthetic resin; and elastic members that are provided to push the stack rollers against the outer peripheral surfaces of the feed rollers, the elastic members applying elastic forces to the stack rollers such that a frictional force between paper money to be deposited and the stack rollers is smaller than a frictional force between paper money to be deposited and the feed rollers, wherein the stack rollers are not rotated while the paper money to be deposited comes in contact with the peripheral surface of each stack roller, wherein the wings push the end of the paper money released from the stack roller when the stack rollers are rotated, and wherein a central shaft of each stack roller is fitted to one end of a stack roller fixing member, a stack roller supporting member is swingably connected to the other end of the stack roller fixing member by a pin, and a stack roller pivot around which the elastic members are wound is fitted to the stack roller supporting member.

2. The automatic teller machine of claim 1, wherein a rotation limiting portion having a square shape is formed at one corner of the stack roller fixing member, and a rotation portion having a round shape is formed at the other corner of the stack roller fixing member.

* * * * *